US009791186B2

(12) United States Patent
Boarman et al.

(10) Patent No.: US 9,791,186 B2
(45) Date of Patent: Oct. 17, 2017

(54) REFRIGERATOR WITH ICEMAKER CHILLED BY THERMOELECTRIC DEVICE COOLED BY FRESH FOOD COMPARTMENT AIR

(71) Applicant: Whirlpool Corporation, Benton Harbor, MI (US)

(72) Inventors: Patrick J. Boarman, Evansville, IN (US); Brian K. Culley, Evansville, IN (US); Gregory G. Hortin, Henderson, KY (US); Mark E. Thomas, Corydon, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 46 days.

(21) Appl. No.: 14/875,280

(22) Filed: Oct. 5, 2015

(65) Prior Publication Data

US 2016/0025390 A1 Jan. 28, 2016

Related U.S. Application Data

(63) Continuation of application No. 13/691,877, filed on Dec. 3, 2012, now Pat. No. 9,151,524.

(51) Int. Cl.
*F25B 21/04* (2006.01)
*F25C 1/04* (2006.01)
(Continued)

(52) U.S. Cl.
CPC ..... *F25B 21/04* (2013.01); *F25C 1/04* (2013.01); *F25B 21/02* (2013.01);
(Continued)

(58) Field of Classification Search
CPC ..... F25C 1/04; F25C 2400/10; F25C 5/02; F25C 2600/02; F25C 2600/04;
(Continued)

(56) References Cited

U.S. PATENT DOCUMENTS 3,192,726 A 7/1965 Newton
5,409,547 A * 4/1995 Watanabe ..... H01L 35/32 136/201
(Continued)

FOREIGN PATENT DOCUMENTS

DE 102010001465 A1 8/2011
DE 102010042080 A1 4/2012
(Continued)

OTHER PUBLICATIONS

EP Search Opinion, EP2738483, Dated Feb. 2, 2015.
(Continued)

*Primary Examiner* — Mohammad M Ali
(74) *Attorney, Agent, or Firm* — Nyemaster Goode, P.C.

(57) ABSTRACT

An icemaker is mounted remotely from a freezer compartment. The icemaker includes an ice mold. A thermoelectric device is provided and includes a warm side and an opposite cold side. A flow pathway is connected in communication between the cold side of the thermoelectric device and the icemaker. In one aspect, a fan is operatively positioned to move air from the fresh food compartment across the warm side of the thermoelectric device and a pump moves fluid from the cold side of the thermoelectric device to the icemaker. Cold air, such as from a refrigerator compartment, may be used to dissipate heat from the warm side of the thermoelectric device for providing cold fluid to and for cooling the ice mold of the icemaker.

20 Claims, 12 Drawing Sheets

(51) Int. Cl.
*F25B 21/02* (2006.01)
*F25D 17/06* (2006.01)
*F25D 23/12* (2006.01)

(52) U.S. Cl.
CPC ..... *F25C 2400/10* (2013.01); *F25D 17/065* (2013.01); *F25D 23/126* (2013.01); *F25D 2317/061* (2013.01)

(58) Field of Classification Search
CPC ..... F25B 21/04; F25B 21/02; F25B 2500/31; F25B 2600/112; F25D 23/126; F25D 2317/061; F25D 17/065
USPC ..... 62/3.63, 449
See application file for complete search history.

(56) References Cited

U.S. PATENT DOCUMENTS

| | | | |
|---|---|---|---|
| 6,003,319 | A | 12/1999 | Gilley et al. |
| 6,293,107 | B1 | 9/2001 | Kitagawa et al. |
| 6,401,461 | B1 | 6/2002 | Harrison et al. |
| 6,735,959 | B1 | 5/2004 | Najewicz |
| 6,951,113 | B1 | 10/2005 | Adamski |
| 7,188,479 | B2 | 3/2007 | Anselmino et al. |
| 7,210,298 | B2 | 5/2007 | Lin |
| 7,278,269 | B2 | 10/2007 | Pham et al. |
| 7,278,569 | B2 | 10/2007 | Cohen et al. |
| 7,284,379 | B2 | 10/2007 | Pham et al. |
| 7,310,953 | B2 | 12/2007 | Pham et al. |
| 7,568,354 | B2 | 8/2009 | Coulter et al. |
| 7,591,141 | B2 | 9/2009 | Wetekamp et al. |
| 7,752,852 | B2 | 7/2010 | Ajei et al. |
| 7,870,745 | B2 | 1/2011 | Goenka |
| 8,429,927 | B2 | 4/2013 | Lee et al. |
| 8,572,999 | B2 | 11/2013 | Kim et al. |
| 2002/0162339 | A1 | 11/2002 | Harrison et al. |
| 2003/0029174 | A1 | 2/2003 | Lee |
| 2004/0144100 | A1 | 7/2004 | Hwang |
| 2006/0168983 | A1 | 8/2006 | Tatsui et al. |
| 2006/0260325 | A1 | 11/2006 | Lin |
| 2006/0260333 | A1 | 11/2006 | Wetekamp et al. |
| 2006/0260350 | A1 | 11/2006 | Van Meter et al. |
| 2006/0260351 | A1 | 11/2006 | Coulter et al. |
| 2007/0186570 | A1* | 8/2007 | Kopf ..... F25C 5/187 62/135 |
| 2007/0227176 | A1* | 10/2007 | Anell ..... F25C 5/185 62/340 |
| 2008/0041066 | A1 | 2/2008 | Luo |
| 2008/0148763 | A1 | 6/2008 | Boarman et al. |
| 2009/0049858 | A1 | 2/2009 | Lee et al. |
| 2009/0158768 | A1 | 6/2009 | Rafalovich et al. |
| 2009/0158928 | A1 | 6/2009 | Wu et al. |
| 2009/0260371 | A1 | 10/2009 | Kuehl et al. |
| 2009/0277210 | A1 | 11/2009 | Eveland et al. |
| 2010/0126185 | A1 | 5/2010 | Cho et al. |
| 2011/0219789 | A1* | 9/2011 | Grosse ..... F25C 1/16 62/73 |
| 2012/0096872 | A1 | 4/2012 | Cheong et al. |
| 2012/0167596 | A1 | 7/2012 | Krause et al. |

FOREIGN PATENT DOCUMENTS

| | | | |
|---|---|---|---|
| EP | 1253387 | A1 | 10/2002 |
| EP | 1684036 | A2 | 7/2006 |
| EP | 1821051 | A1 | 8/2007 |
| EP | 2444761 | A2 | 4/2012 |

OTHER PUBLICATIONS

EP Search Opinion, EP2738484, Dated Feb. 23, 2015.
EP Search Opinion, EP2738485, Dated Feb. 2, 2015.
EP Search Opinion, EP2738496, Dated Feb. 2, 2015.
EP Search Opinion, EP2738497, Dated Feb. 2, 2015.
DE102010042080 Machine Translation from Espacenet.
DE102010001465 Machine Translation from Espacenet.
Vian, J. et al, "Development of a Thermoelectric Ice Maker of Fingers Incorporated into a Static Domestic Refrigerator", 5th European Conference on Thermoelectrics, Sep. 10, 2007, pp. 1-16.

* cited by examiner

REFRIGERATOR WITH ICEMAKER CHILLED BY THERMOELECTRIC DEVICE COOLED BY FRESH FOOD COMPARTMENT AIR

CROSS REFERENCE TO RELATED APPLICATION

This application claims priority to U.S. Ser. No. 13/691,877, filed on Dec. 3, 2012, entitled "REFRIGERATOR WITH ICEMAKER CHILLED BY THERMOELECTRIC DEVICE COOLED BY FRESH FOOD COMPARTMENT AIR," the disclosure of which is hereby incorporated herein by reference in its entirety.

FIELD OF THE INVENTION

The invention relates generally to refrigerators with icemakers, and more particularly to refrigerators with the icemaker located remotely from the freezer compartment.

BACKGROUND OF THE INVENTION

Household refrigerators commonly include an icemaker to automatically make ice. The icemaker includes an ice mold for forming ice cubes from a supply of water. Heat is removed from the liquid water within the mold to form ice cubes. After the cubes are formed they are harvested from the ice mold. The harvested cubes are typically retained within a bin or other storage container. The storage bin may be operatively associated with an ice dispenser that allows a user to dispense ice from the refrigerator through a fresh food compartment door.

To remove heat from the water, it is common to cool the ice mold. Accordingly, the ice mold acts as a conduit for removing heat from the water in the ice mold. When the ice maker is located in the freezer compartment this is relatively simple, as the air surrounding the ice mold is sufficiently cold to remove heat and make ice. However, when the icemaker is located remotely from the freezer compartment, the removal of heat from the ice mold is more difficult.

Therefore, the proceeding disclosure provides improvements over existing designs.

SUMMARY OF THE INVENTION

According to one exemplary aspect, a refrigerator that has a fresh food compartment, a freezer compartment, and a door that provides access to the fresh food compartment is disclosed. An icemaker is mounted remotely from the freezer compartment. The icemaker includes an ice mold. Also included is a thermoelectric device. The thermoelectric device has a warm side and an opposite cold side. A flow path is connected in communication between the cold side of the thermoelectric device and the icemaker and a fan is positioned to move air from the fresh food compartment across the warm side of the thermoelectric device. A fluid loop on the door in communication between the thermoelectric device and the icemaker supplies cold fluid to the ice mold from the thermoelectric device. An insulated compartment may also be included on the door. An ice storage bin within the insulated compartment is positioned to receive ice harvested from the ice mold. A flow path is positioned in communication between the insulated compartment and thermoelectric device for cooling the insulated compartment housing the ice storage bin.

According to another exemplary aspect, a refrigerator that has a fresh food compartment, a freezer compartment and a door that provides access to the fresh food compartment is disclosed. The refrigerator includes an icemaker mounted remotely from the freezer compartment. The icemaker includes an ice mold. A thermoelectric device is used that includes a warm side and opposite cold side. A pump is positioned to move fluid from the cold side of the thermoelectric device to the icemaker and a fan is positioned to move air from the fresh food compartment across the warm side of the thermoelectric device. A heat exchange interface may be provided between the fluid supply pathway and a cooling application on the door or a fluid return pathway and a warming application on the door.

According to another exemplary aspect, a method for providing ice from an icemaker in a cabinet body is disclosed. The method includes an icemaker module having an icemaker with an ice mold selectively positioned within a cabinet body having an ice receiving area. The ice mold is cooled with a thermoelectric device positioned on the icemaker module. The thermoelectric device has a cold side and a warm side. A heat carrying medium is moved on the icemaker module between the ice mold and the cold side of the thermoelectric device for chilling the ice mold. The heat is removed from the icemaker module from off the warm side of the thermoelectric device.

BRIEF DESCRIPTION OF THE DRAWINGS

While the specification concludes with claims particularly pointing out and distinctly claiming the invention, it is believed that the various exemplary aspects of the invention will be better understood from the following description taken in conjunction with the accompanying drawings, in which:

DETAILED DESCRIPTION OF THE PREFERRED EMBODIMENTS

Figure 1A:
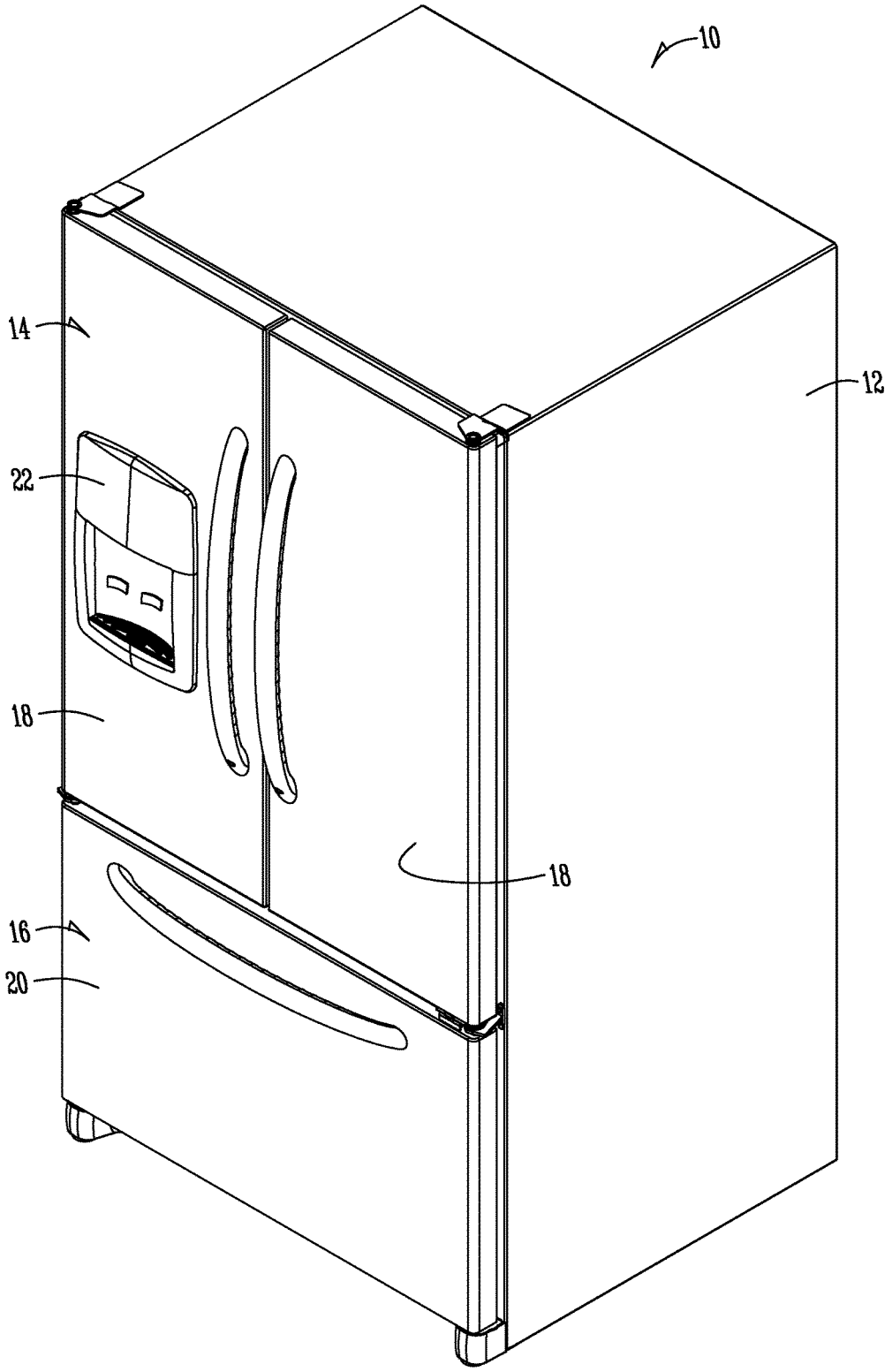
FIG. 1A is a perspective view of a refrigerator in accordance with an exemplary aspect of the invention.

By way of illustration, FIGS. 1-9 provide exemplary features, aspects and embodiments for a refrigerator 10 of the present invention. The refrigerator 10 includes a cabinet body 12 with a refrigerator compartment or fresh food compartment 14 selectively closeable by a refrigerator compartment door 18 and a freezer compartment 16 selectably closeable by a freezer compartment door 20. A dispenser 22 is included on the refrigerator compartment door 18 for providing dispensions of liquid and/or ice at the refrigerator compartment door 18. Although one particular design of a refrigerator 10 is shown in FIG. 1A and replicated throughout various figures of the present invention, other refrigerator styles and configurations are contemplated. For example, the refrigerator 10 could be a side-by-side refrigerator, a refrigerator with the freezer compartment positioned above the refrigerator compartment (top-mount refrigerator), a refrigerator with the freezer compartment positioned beneath the refrigerator compartment (bottom-mount refrigerator), a refrigerator that includes only a refrigerator or fresh food compartment and no freezer compartment, etc. In the figures is shown a bottom-mount refrigerator 10 where the freezer compartment 16 is located below the refrigerator compartment 14. The concepts of the present invention may also be incorporated into other refrigerated platforms. For example, a water dispenser/cooler 10 (See FIG. 1B), a countertop dispenser 10 (See FIG. 1C), an under-counter dispenser 10 (See FIG. 1D) may be configured with one or more aspects of the present invention.

Figure 2:
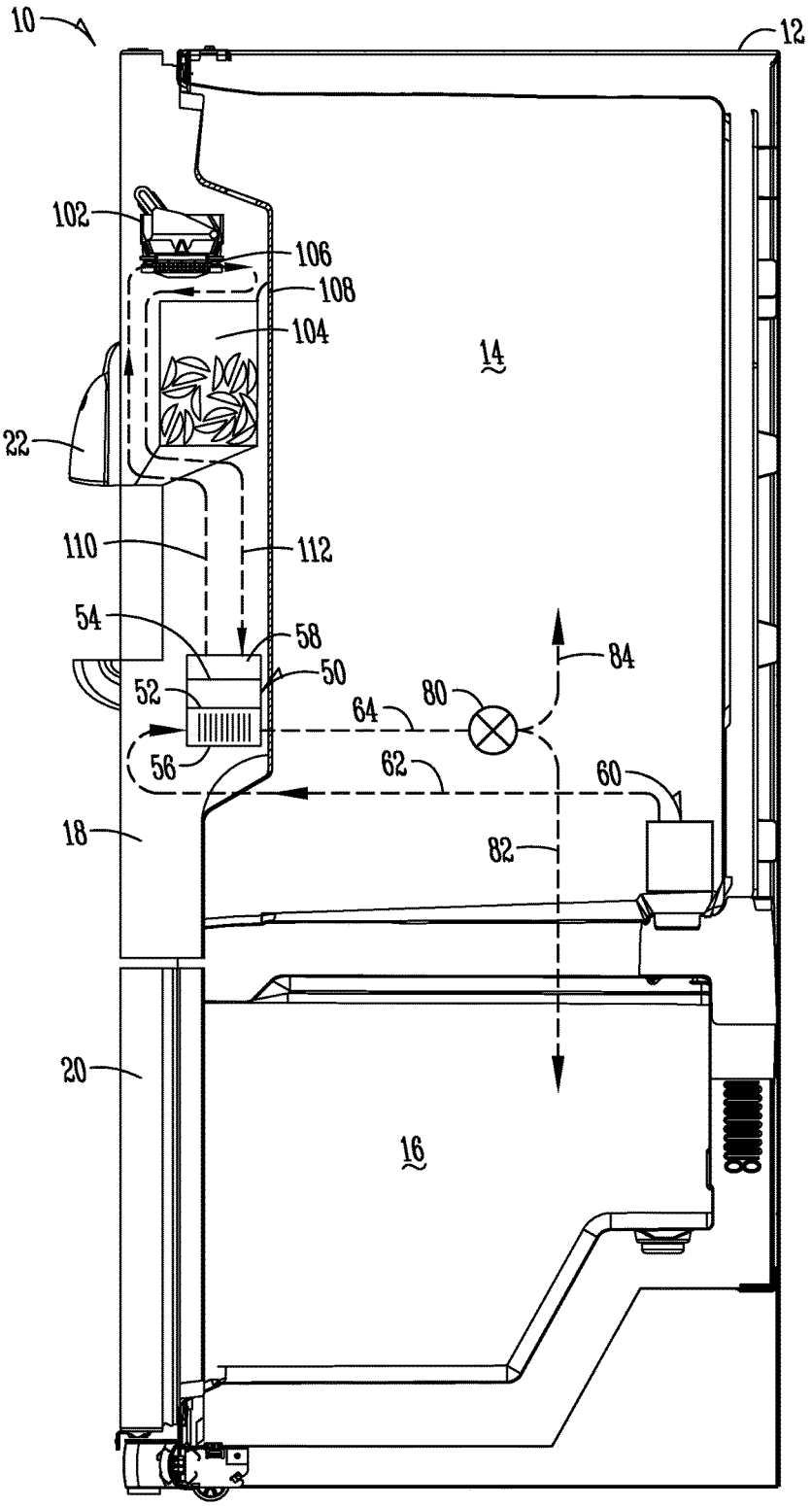
FIG. 2 is a side elevation of a sectional view of the refrigerator shown in FIG. 1.
Figure 3:
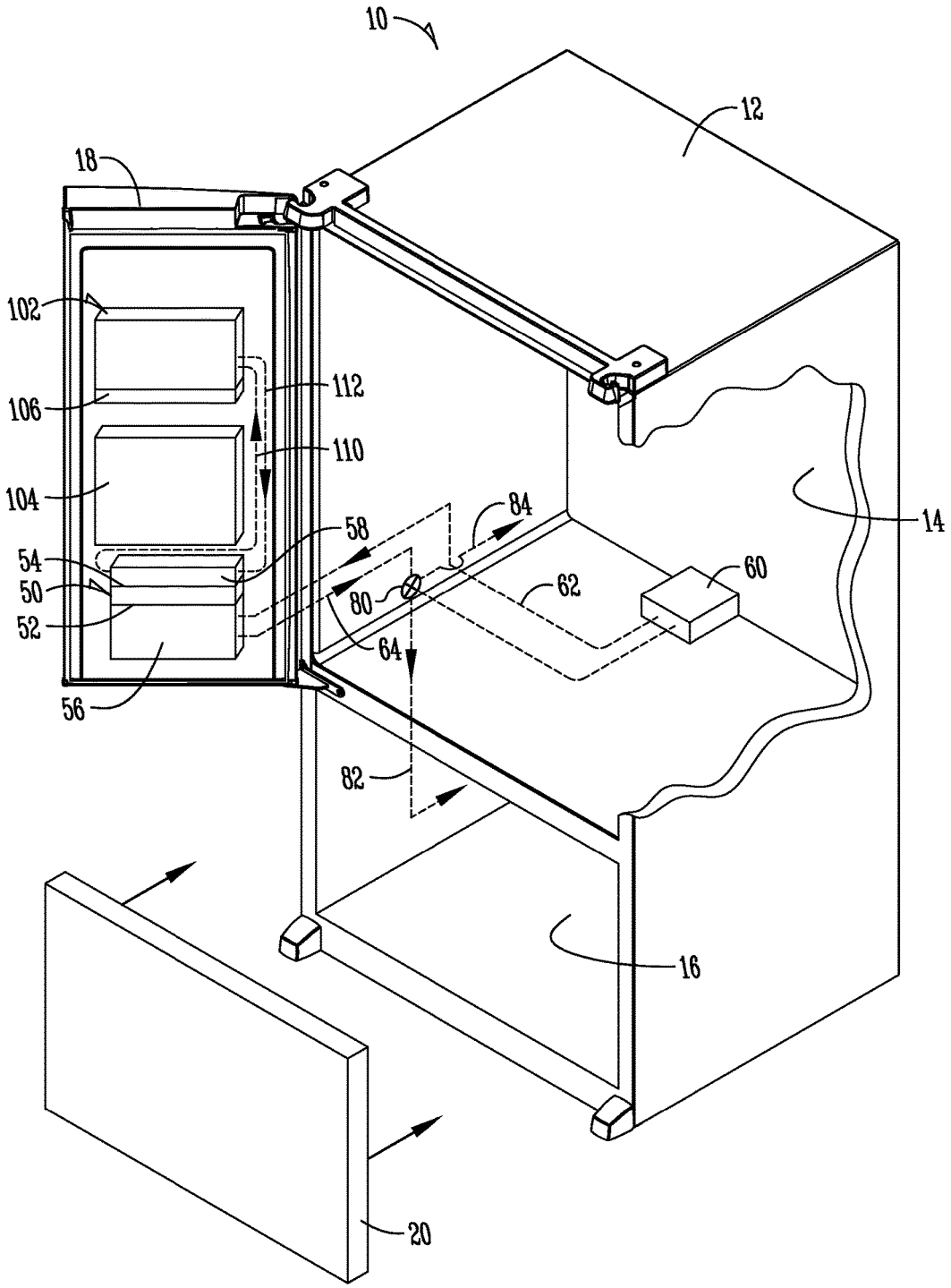
FIG. 3 is a perspective view with a cutaway illustrating various exemplary aspects within the refrigerator on the door of the refrigerator in accordance with an aspect of the invention.

Several aspects of the present invention are illustrated in the sectional and cutout views of refrigerator 10 shown in FIGS. 2 and 3. In connection with the dispenser 22 on the cabinet body 12 of the refrigerator 10, such as for example on the refrigerator compartment door 18, is an icemaker 102 having an ice mold 106 for extracting heat from liquid within the ice mold to create ice which is dispensed from the ice mold 106 into an ice storage bin 104. The ice is stored in the ice storage bin 104 until dispensed from the dispenser 22. The ice mold 106 or icemaker 102 may include a fluid sink (not shown) for extracting heat from the ice mold 106 using a fluid as the extraction medium. The present invention also contemplates that air may be used as the medium for carrying away heat form the ice mold 106. According to one aspect of the present invention, a fluid supply pathway 110 is connected between the icemaker 102 and a thermoelectric device 50. A fluid return pathway 112 is also connected between the icemaker 102 and the thermoelectric device 50. The fluid supply pathway 110 and the fluid return pathway 112 together form a fluid loop connecting the icemaker 102 with the thermoelectric device 50. The fluid supply pathway 110 and fluid return pathway 112 could also be configured as air pathways (e.g., an air supply pathway and an air return pathway) connected between the icemaker 102 and thermoelectric device 50. The pathways 110, 112 may include a conduit, line, ductwork, or other enclosed flow path to facilitate the transfer of a heat carrying medium (e.g., fluid or air) between the icemaker 102 and the thermoelectric device 50. In one aspect of the invention, fluid supply pathway 110 and fluid return pathway 112 are connected to a fluid sink 58 positioned on the cold side 54 of the thermoelectric device 50. The fluid sink 58 provides a thermal transfer pathway between the fluid carrier and the cold side 54 of the thermoelectric device 50. The fluid in the line between the icemaker 102 and the thermoelectric device 50 may be a heat transfer fluid such as ethylene or propylene glycol. The fluid in the line between the icemaker 102 and the thermoelectric device 50 may be a heat transfer fluid such as ethylene or propylene glycol. As the fluid temperature may drop below freezing, it may be beneficial to use an anti-freeze, such as glycol, such that the fluid will not freeze when passing through the fluid pathways 110, 112. The fluid in the fluid pathways could also be water or other chemically altered fluid suitable for use in combination food.

The cold side 54 of the thermoelectric device 50 is kept generally at a temperature below the temperature required for making ice (e.g., temperatures near or below 0° Fahrenheit). Conversely, the warm side 52 of the thermoelectric device 50 is operated at a temperature of the desired temperature for the fluid used to cool the ice mold plus the operating delta for the thermoelectric device 50. For example, if the delta for the thermoelectric device 50 is 20° Fahrenheit, the warm side 52 of the thermoelectric device 50 must be kept at a temperature less than 52° Fahrenheit to maintain the cold side 54 of the thermoelectric device 50 at 32° Fahrenheit or below. An electrical current is provided to the thermoelectric device 50 which provides the necessary Peltier effect that creates a heat flux and provides a cold side 54 and warm side 52 during operation. To dissipate heat from the warm side 52 of the thermoelectric device 50, an air sink 56 is configured in operable thermal operation with the warm side 52 of the thermoelectric device 50. An air supply pathway 62 is connected between the air sink 56 and a fan 60 positioned within the refrigerator compartment 14 of the refrigerator 10. An air return pathway 64 is connected between the air sink 56 and the refrigerator compartment 14 and/or freezer compartment 16, wherein flow there through is selectably open and closed by operation of flow controller 80. In a typical refrigerator, the refrigerator compartment 14 is kept generally between 32° Fahrenheit and about 40° Fahrenheit. A fan 60 or other means (e.g., pump) for moving air through a ductwork or other channel is positioned within the refrigerator compartment 14 at a location such as adjacent the mullion that separates the refrigerator compartment 14 from the freezer compartment 16. Other embodiments are contemplated. For example, the fan 60 may be positioned within a mullion or sidewall of the cabinet body 12 of the refrigerator 10. Advantageously, positioning the fan 60 adjacent the horizontal mullion that separates the refrigerator compartment from the freezer compartment draws cooler air within the refrigerator compartment 14 given that the cooler air within the refrigerator compartment 14 is generally located closer to or adjacent the horizontal mullion that separates the refrigerator compartment 14 from the freezer compartment 16. The cool air may be ducted out of the refrigerator compartment 14 through an air supply pathway 62 using fan 60. The fan may also be positioned within the insulated compartment 108 on the refrigerator compartment door 18. The cool air pumped to the air sink 56 at the thermoelectric device 50 may be exhausted back into the refrigerator compartment 14 or into the freezer compartment 16. A flow controller 80 may be provided within the air return pathway 64 to direct flow through an air return pathway 84 that exhausts into the refrigerator compartment or an air return pathway 82 that exhausts into the freezer compartment 16. The present invention contemplates that other pathways may be configured so that air from the air return pathway 64 is communicated to other locations within the cabinet body of the refrigerator 12. For example, the air within the air return pathway 64 may be communicated to a discreet (e.g., modulated space or bin), or desired space within the refrigerator compartment 14 or freezer compartment 16. A separate cabinet, bin or module within the freezer compartment 16 or refrigerator compartment 14 may be configured to receive air exhausted from the thermoelectric device 50 through the air return pathway 64. A junction may be provided in the air supply pathway 62 at the interface between the refrigerator compartment door 18 and the refrigerator compartment 14. The interface (not shown) between the refrigerator compartment 14 and refrigerator compartment door 18 is sealed and separated upon opening and closing the refrigerator compartment door 18. Alternatively, the air supply pathway 62 may be configured through another attachment or interface point of the refrigerator compartment door 18 such as a hinge point at a top or bottom portion of the door. Thus, cool air from the refrigerator compartment 14 is communicated through the air supply pathway 62 to the air sink 56 of the thermoelectric device 50. The air temperature in the refrigerator compartment 14 ranges generally between 32° Fahrenheit and about 40° Fahrenheit and the temperature on the cold side 54 of the thermoelectric device 50 ranges anywhere from about 32° Fahrenheit to 40° Fahrenheit minus the temperature delta of the thermoelectric device. Assuming the refrigerator compartment is set at 35° Fahrenheit and the thermoelectric device has a delta of 10 degrees, the cold side 54 of the thermoelectric device 50 would operate generally at 25° Fahrenheit. The liquid in the fluid supply pathway 110 is cooled generally then to the temperature of the cold side 54 of the thermoelectric device 50. Heat from the ice mold 106 is extracted and carried away from the icemaker 102 through the fluid return pathway 112. Depending upon the desired rate of production of ice, the flow rate of fluid through the fluid supply pathway 110 and the flow rate of air through the air supply pathway 62 may be controlled so that the warm side 52 and cold side 54 of the thermoelectric device 50 are kept at the desired operating temperatures so that ice production can be maintained at a desired rate of production by extracting heat from the ice mold 106 of the icemaker 102 at a rate that is capable of sustaining the desired level of ice production. The rate of operation for these various components may be controlled to use the least amount of energy necessary for keeping up with the desired rate of ice production.

Figure 4:
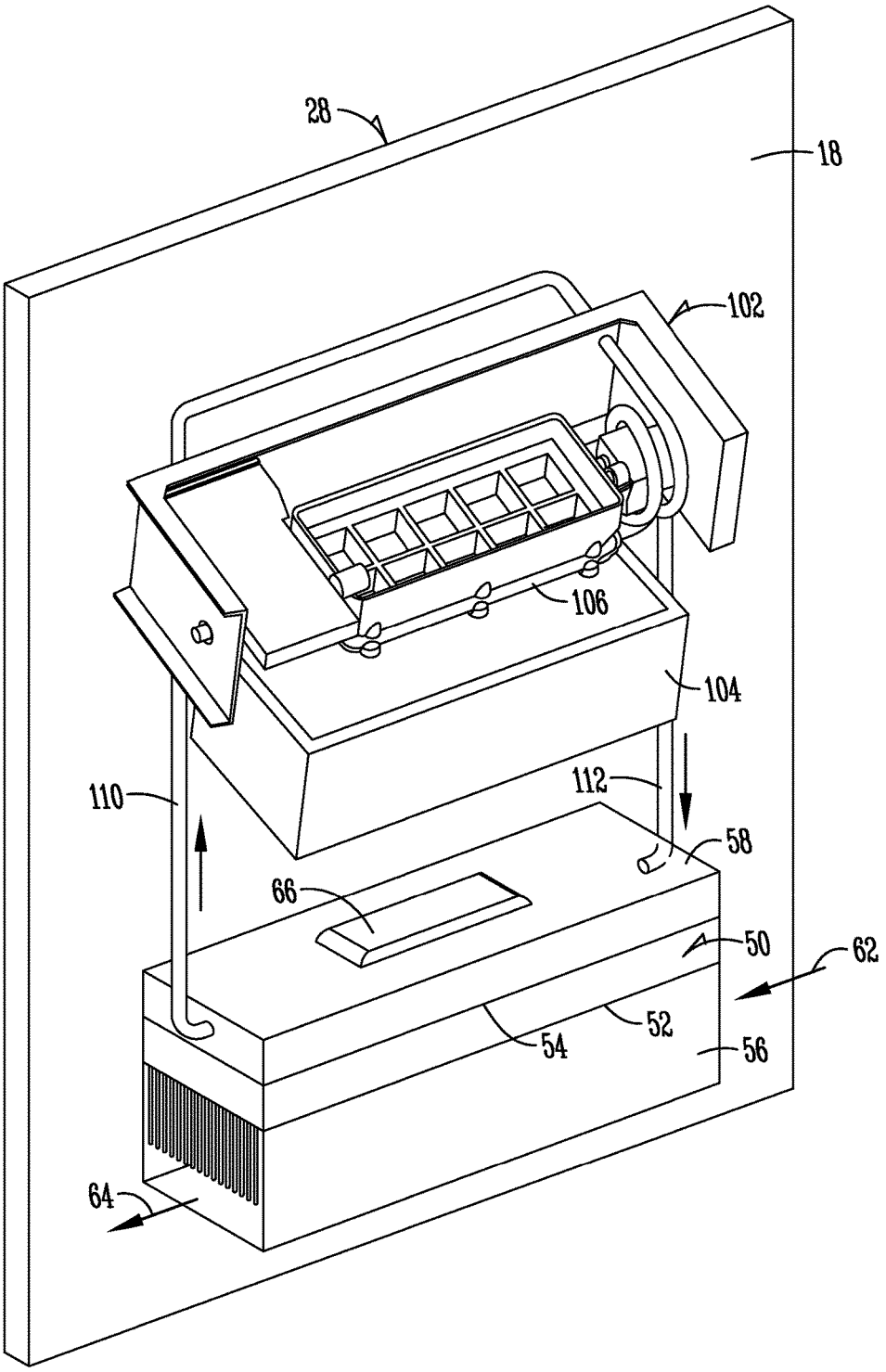
FIG. 4 is a perspective view of the inside of a door of the refrigerator according to one exemplary aspect of the invention.

As illustrated in FIG. 4, the air sink 56 may include a plurality of fins to allow heat to be dissipated from the warm side 52 of the thermoelectric device 50 using air from the refrigerator compartment 14 to pass through the air supply pathway 62 and return to the refrigerator compartment or freezer compartment through the air return pathway 64. The fluid in the fluid supply pathway 110 and fluid return pathway 112 may be communicated through the fluid sink 58 and the ice mold 106 by actuation of a pump 66. The ice mold 106 may include a number of aqueducts or channels for passing fluid through for cooling the ice mold or extracting heat from the ice. Using fluid to cool the ice mold 106 allows various types of icemakers to be used, such as a flex-tray icemaker. The icemaker 102, ice storage bin 104, and thermoelectric device 50 may be mounted together in a configuration to form an icemaker module 28. The icemaker module 28 may be configured on the refrigerator compartment door 18 as shown in FIG. 4.

Figure 5:
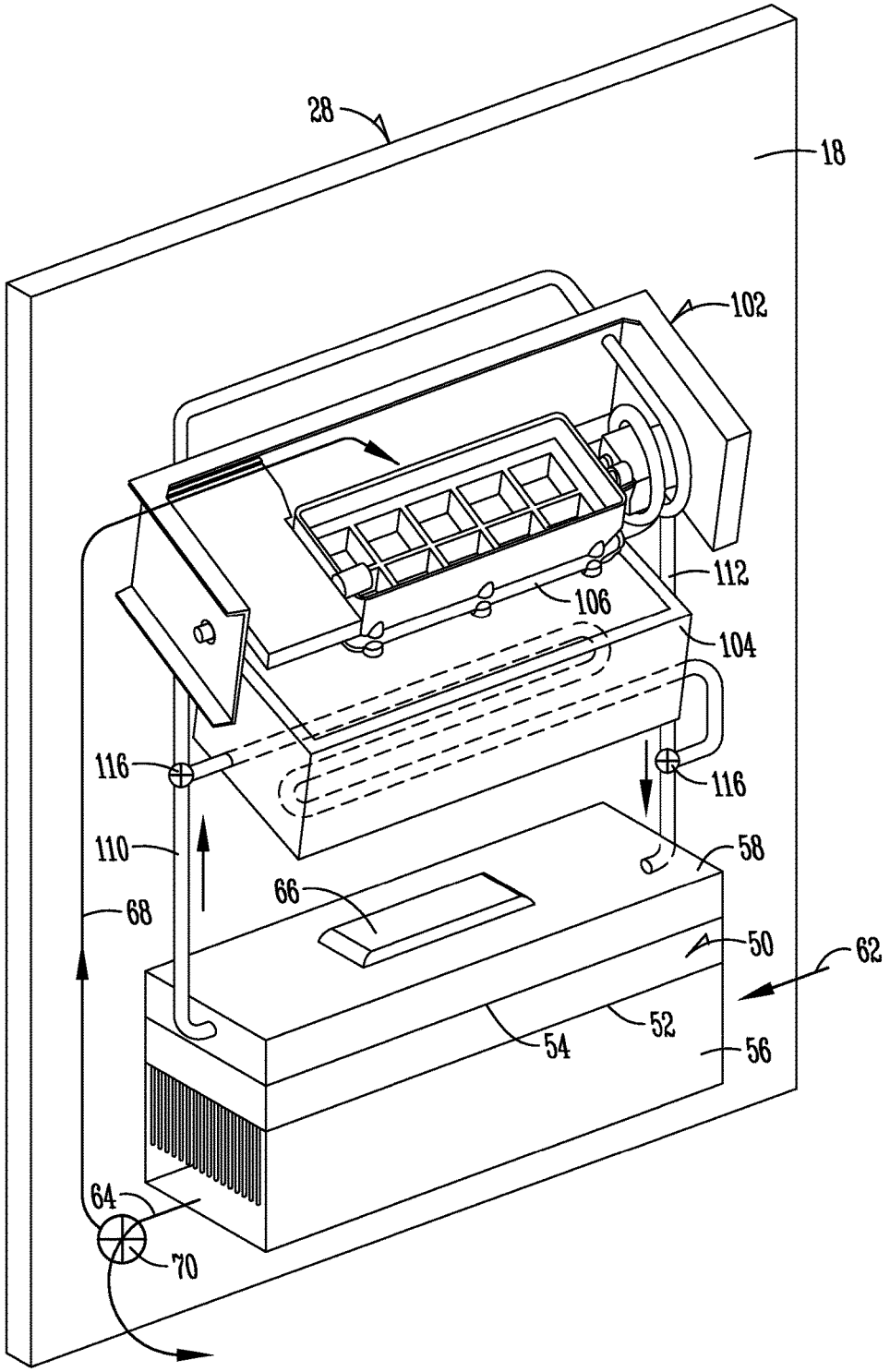
FIG. 5 is a perspective view of the inside of a door of the refrigerator according to another exemplary aspect of the present.

FIG. 5 illustrates other exemplary aspects for one or more configurations of the present invention. The door illustrated in FIG. 5 may be a refrigerator compartment door 18 such as illustrated in FIGS. 1A, 2 and 3. The various components making up the icemaker module 28 (illustrated in FIG. 5) may be housed within an insulated compartment 108 such as illustrated in FIG. 2. As previously illustrated and described, the thermoelectric device 50 includes an air sink 56 configured to receive air through an air supply pathway 62 connected between the thermoelectric device 50 and a fan 60 in the refrigerator compartment 14 of the refrigerator 10. Air passing through the air sink 56 dissipates heat from the warm side 52 of the thermoelectric device 50. The warm air is communicated through an air return pathway 64 to the refrigerator compartment 14 and/or freezer compartment 16. A flow controller 70 may be configured in the air return pathway 64 for selectively controlling the flow of warm air there through. According to one aspect of the invention, warm air may be communicated through an air supply pathway 68 connected between the flow controller 70 and the ice maker 102. Ductwork or other channels of communication may be provided within the refrigerator compartment door 18 or within the insulated compartment 108 for communicating air between the flow controller 70 and the icemaker 102. Advantageously, during an ice harvesting cycle, warm air from the air sink 56 may be communicated through air supply pathway 68 to the ice mold 106 to assist in the ice harvesting process whereby the ice mold 106 is warmed to a temperature to create a thin fluid layer between the frozen ice and the side walls of the ice mold to allow each of the cubes to release from the ice mold during harvesting. One or more ducts or channels may be configured within the ice mold 106 to direct the flow of warm air within the air supply pathway 68 to specific regions or locations within the icemaker. The air supply pathway 68 may also be configured to communicate warm air through one or more ducts positioned adjacent to or in contact with the ice mold 106 for warming the ice mold 106 by convection or conduction.

In addition to cooling the ice mold 106, the fluid supply pathway 110 originating at the fluid sink 58 of the thermoelectric device 50 may be configured with a flow controller 116 for selectively communicating the cold fluid through the ice storage bin 104 (e.g., the sidewalls of the ice storage bin). For cooling the ice storage bin 104, a flow controller 116 may also be included in the fluid return pathway 112 for controlling liquid flow through the fluid return pathway 112 into the fluid sink 58. The flow controllers 116 may be operated to allow both cooling of the ice mold 106 and the ice storage bin 104 simultaneously to the extent the demand on the thermoelectric device 50 does not exceed its capabilities. Thus, the ability to extract heat using air from the refrigerator compartment for cooling the thermoelectric device 50 may be used to provide other cooling operations on the refrigerator compartment door as illustrated in FIG. 5.

Figure 6:
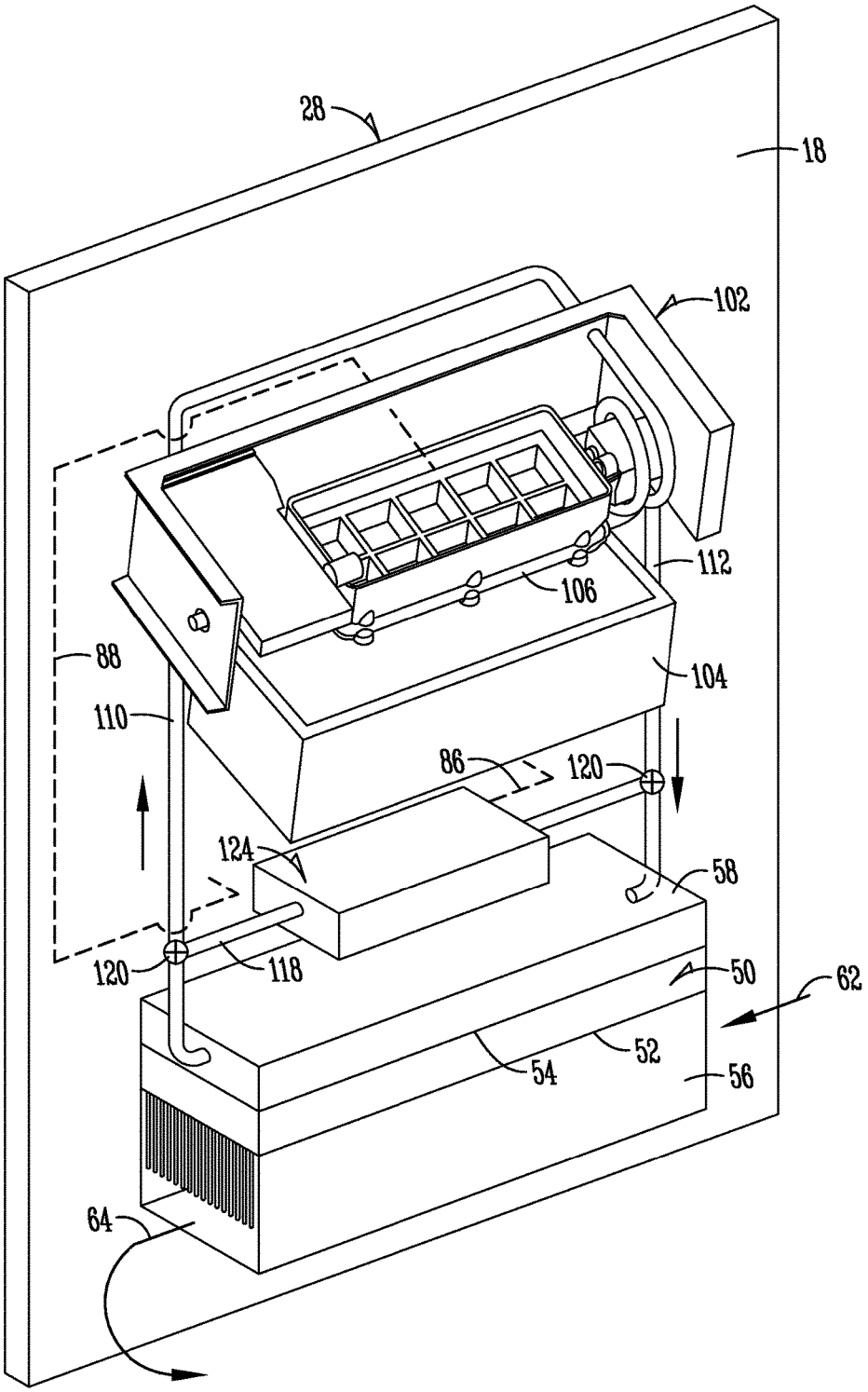
FIG. 6 is a perspective view of the inside of a door of the refrigerator in accordance with an exemplary aspect of the invention.

FIG. 6 illustrates another possible cooling application according to an exemplary aspect of the present invention. Beneficially, aspects of the present invention, such as those illustrated in FIG. 6, provide for both cooling and heating applications on, for example, a refrigerator compartment door 18 of a refrigerator 10. The cooling and heating applications may also be included as components or subcomponents of the icemaker module 28. As indicated previously, the thermoelectric device 50 has a warm side 52 and a cold side 54. The cold side is in thermal contact with the fluid sink 58 and the warm side is in thermal contact with the air sink 56. Reversing the polarity of the thermoelectric device 50 changes the warm side 52 to a cold side and the cold side 54 to a warm side. The thermoelectric device 50 may be operated in two modes, namely the mode illustrated in FIG. 6 and in a mode where the warm and cold sides are switched. In the mode illustrated in FIG. 6, the cold side 54 is in thermal contact with the fluid sink 58 and the warm side 52 is in thermal contact with the air sink 56. A fluid supply pathway 110 is connected between the icemaker 102 and the fluid sink 58. A flow controller 120 in the fluid supply pathway 110 is selectable between open and closed positions. A fluid supply pathway 118 is connected between the fluid supply pathway 110 and the fluid return pathway 112 by a flow controller 120. The fluid supply pathway 118 is connected to a warming or cooling application 124. Thus, the fluid supply pathway 110 may be used to supply cold fluid to the cooling application 124 via fluid supply pathway 118 by selectably changing the flow controller 120 in both the fluid supply pathway 110 and fluid return pathway 112. The warming or cooling application 124 may include a reservoir housing a body of liquid. The liquid in the reservoir may be supplied to the icemaker 102 through supply pathway 88 or supplied to the refrigerator 10 through supply pathway 86 for dispensing from the dispenser 22. Cooling liquid passed through the cooling application 124 cools the reservoir of liquid which may then be communicated to other applications, such as for example, applications on or remote from the refrigerator compartment door 18 that uses cool or chilled liquid. For example, the chilled liquid from the cooling application 124 may be communicated to the icemaker 102 for use in the ice mold 106 to reduce the amount of energy and time to make ice. If the cooling fluid within the fluid supply pathway 118 is at a temperature of 38 to 40 degrees Fahrenheit the water in the reservoir in the cooling application 124 may be cooled generally to the same temperature and communicated to the ice mold 106, which can reduce the amount of time and energy used to freeze the water. Cooling application 124 may also be used to cool water that is communicated to the dispenser 22 for dispensing cold water from the refrigerator 10. The chilled water may also be used to provide cooling within the refrigerator compartment 14 by communicating the chilled water across the door 18 into the compartment 14. For example, the chilled liquid may be used for controlling or assisting with the temperature control of a bin, drawer or other defined space. Reversing the polarity of the thermoelectric device 50 cools the air passing through the air return pathway 64 back to the refrigerator compartment 14 or freezer compartment 16 and warms the fluid sink 58. The fluid in the fluid supply pathway 118 may be then used to warm the water within the heating application 124. The warm water within the heating application 124 may be communicated to the dispenser 22 on the refrigerator 10 for dispensing warm water or may be used by the icemaker 102 for ice harvesting or for performing a wash, sanitizing or recycle of the ice mold 106. The warm water may also be communicated to the refrigerator compartment 14 across the door 18 for controlling or assisting with the temperature control of a drawer, bin, or other defined space within the refrigerator compartment 18.

Figure 7:
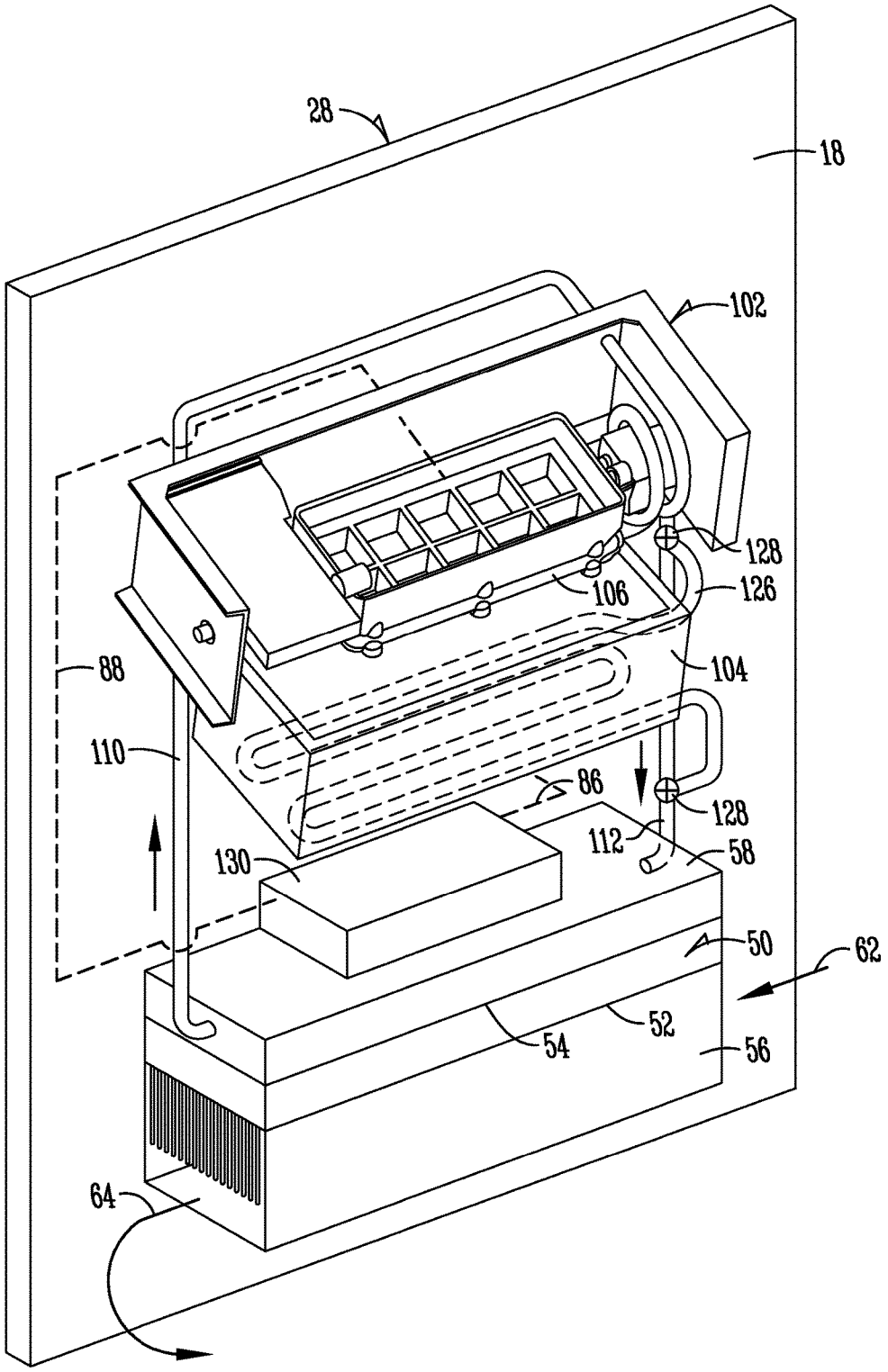
FIG. 7 is a perspective view of the inside of a door of the refrigerator according to another exemplary aspect of the invention.

FIG. 7 illustrates another exemplary configuration contemplated by various aspects of the present invention. The icemaker module 28 may be configured to include other applications in addition to those described above. As indicated previously, the thermoelectric device 50 may be used to support not only primary cooling applications but secondary and possibly tertiary cooling applications or heating applications. FIG. 7 illustrates another exemplary cooling application according to one aspect of the present invention. As the fluid sink 58 is maintained at a temperature minus delta below the air temperature passing through the air supply pathway 62, the fluid sink 58 may be used to provide cooling to various applications, such as, on the door 18 of the refrigerator compartment 14. A reservoir 130, for example, may be provided for housing a body of water to be used for dispensing from the dispenser 22 or used in the icemaker 102 for making ice. Heat may be extracted from the reservoir 130 by placing the reservoir 130 in thermal contact with the fluid sink 58. A supply pathway 86 and 88 may be connected between the dispenser 22 and the reservoir 130 and the icemaker 102 and the reservoir 130 for providing chilled water to either or both. The chilled water may also be used to provide cooling within the refrigerator compartment 14 by communicating the chilled water across the door 18 into the compartment 14. For example, the chilled liquid may be used for controlling or assisting with the temperature control of a bin, drawer or other defined space. As previously indicated, the fluid return pathway 112 carries heat away from the ice mold 106. Beneficially, the heat carried in the fluid return pathway 112 may be used in the ice storage bin 104 for melting ice within the bin 104 for creating fresh or clear ice. A fluid supply pathway 126 may be configured within the ice storage bin 104 (e.g., within the walls of the ice storage bin) for warming the ice within the ice storage bin 104. The fluid supply pathway may be configured between flow controllers 128 which are selectably open and closed to allow or provide for warm fluid flow through the fluid supply pathway 126 within the ice storage bin 104. As the fluid passes through the fluid supply pathway 126 the ice within the ice storage bin 104 is warmed and begins to melt and thereby creates fresh ice. The fluid within the fluid supply pathway 126 is cooled and returned to the fluid sink 58 through the fluid return pathway 112. The fluid may also enter the fluid sink 58 from the fluid return pathway 112 at a temperature lower than the fluid that returns from the ice mold 106 during the ice making process. Thus, the thermoelectric device 50 requires less energy to cool the fluid in the fluid supply pathway 110. As with the warming application 124 shown in FIG. 6, the warmed water in the reservoir 130 may also be communicated to the refrigerator compartment 14 across the door 18 for controlling or assisting with the temperature control of a drawer, bin, or other defined space within the refrigerator compartment 18.

Figure 8:
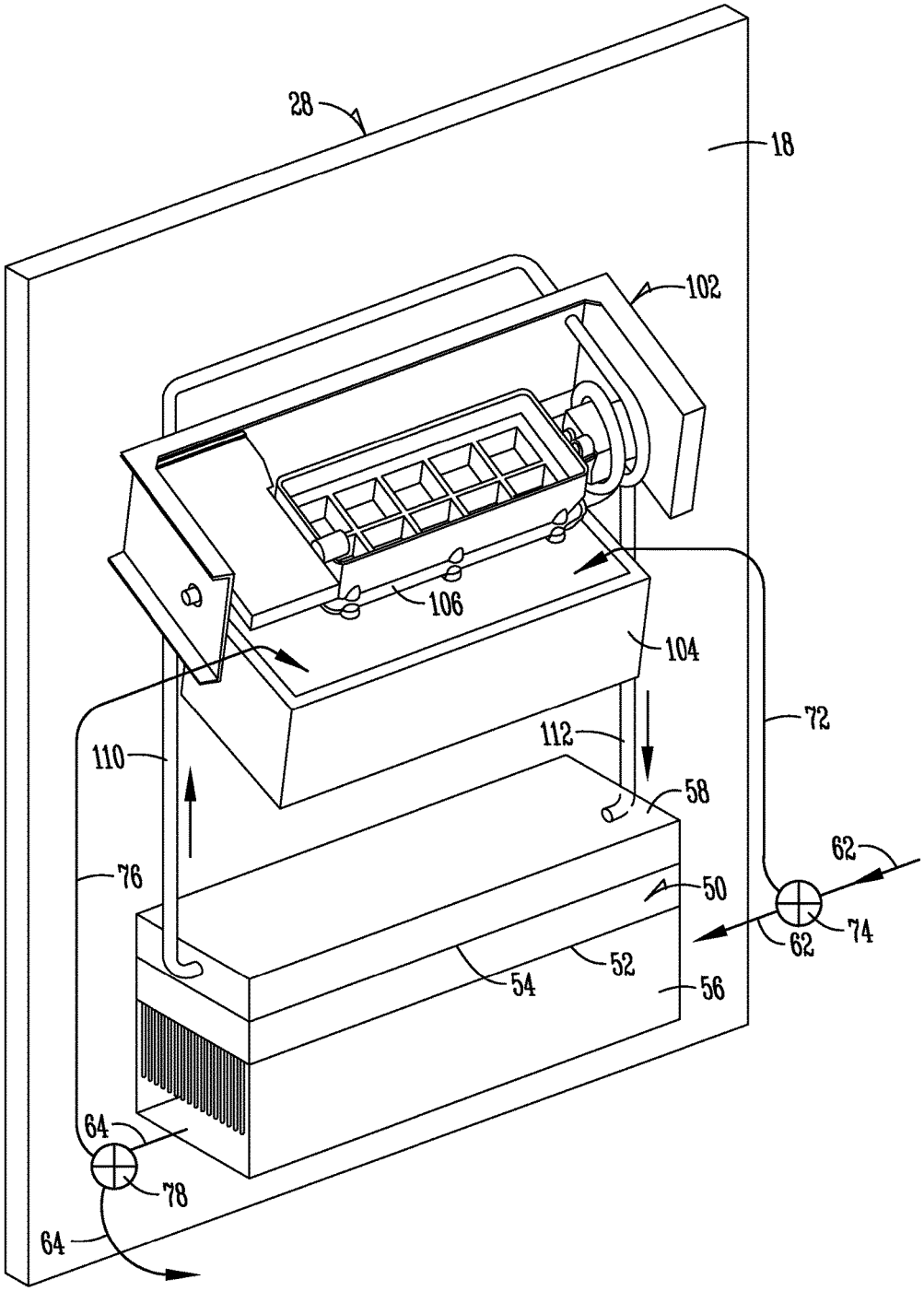
FIG. 8 is a perspective view of the inside of a door of the refrigerator for an exemplary aspect of the invention.

FIG. 8 illustrates another exemplary aspect of the present invention. As previously indicated, an air supply pathway 62 feeds air from the refrigerator compartment 14 to the thermoelectric device 50. According to one aspect of the invention, a flow controller 74 may be configured in the air supply pathway 62 for selectively controlling the flow of air through the pathway. The air in the air supply pathway 62 is generally at the temperature of the refrigerator compartment 14 (i.e., generally between 32° Fahrenheit and 40° Fahrenheit). An air supply pathway 72 may be configured between the ice storage bin 104 and the flow controller 74 whereby air from the refrigerator compartment may be communicated to the ice storage bin 104 for cooling the ice in the ice storage bin. Alternatively, a flow controller 78 may be included in the air return pathway 64 for selectively controlling the flow of air through an air supply pathway 76. The air supply pathway 76 may be connected between the ice storage bin 104 and the flow controller 78 for communicating warm air to the ice storage bin 104 for melting or warming the ice for providing a fresh ice or clear ice product.

Figure 1B:
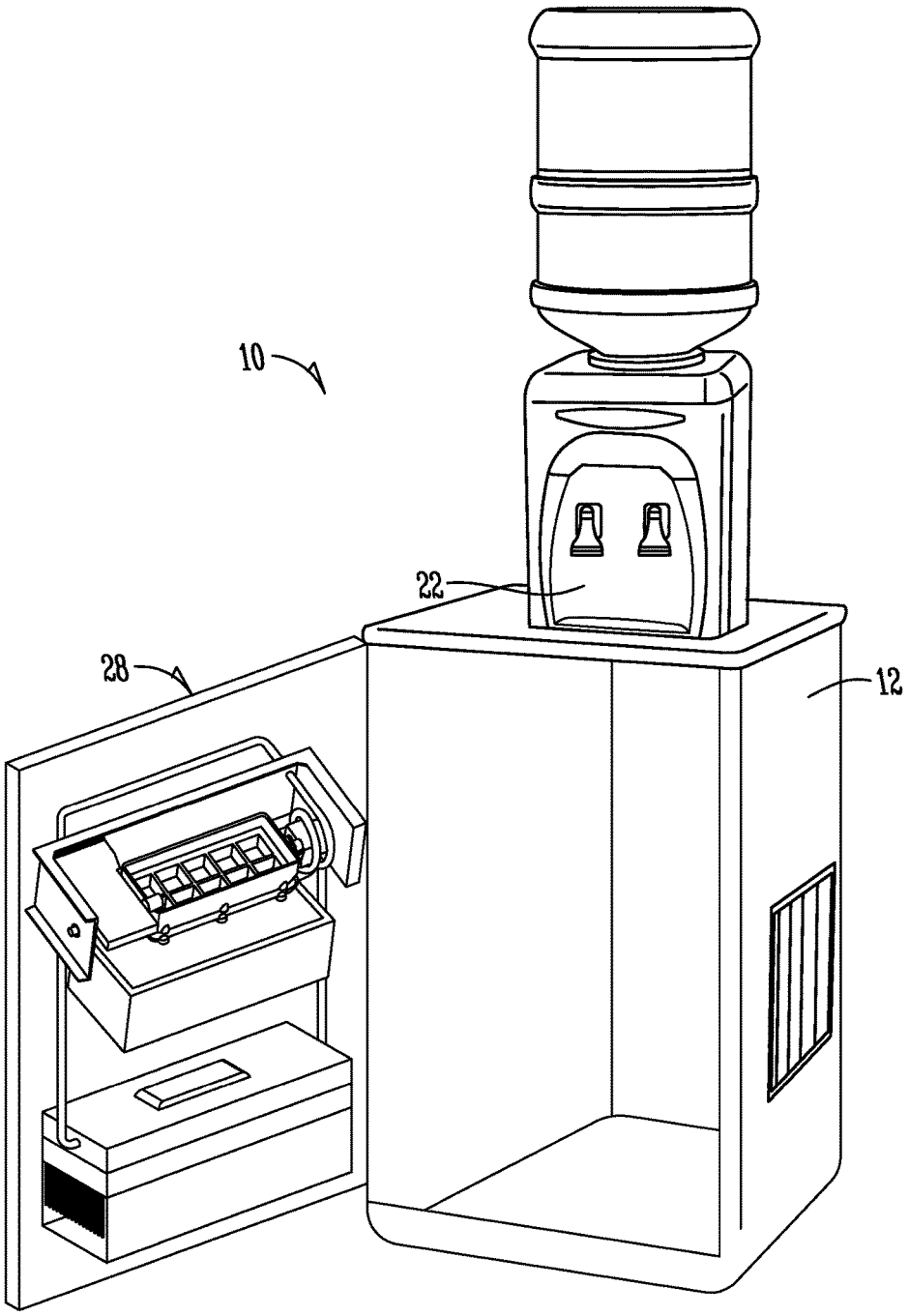
FIG. 1B is a perspective view of a refrigeration platform in accordance with an exemplary aspect of the invention.
Figure 1C:
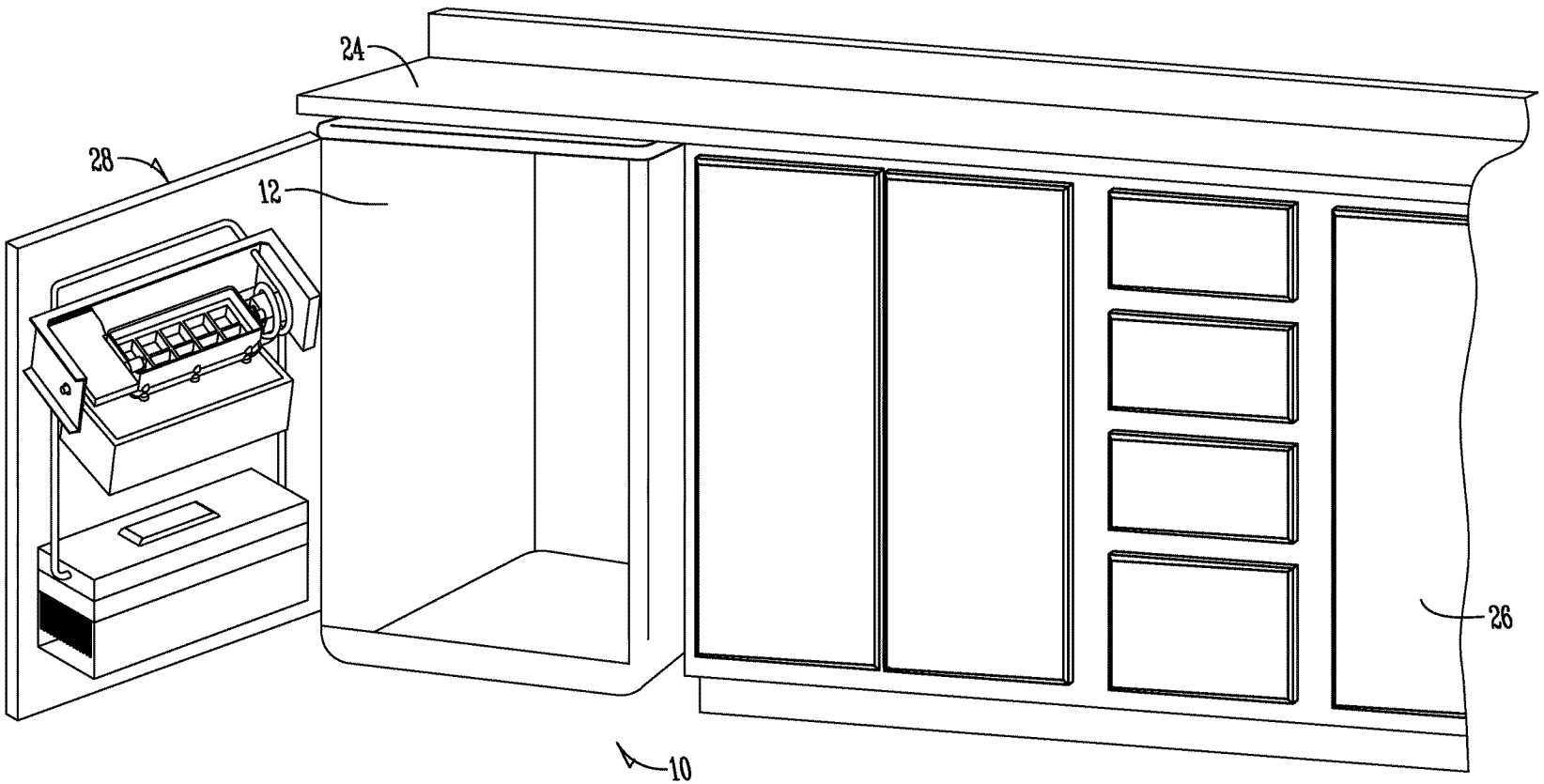
FIG. 1C is a perspective view of another refrigeration platform in accordance with an exemplary aspect of the invention.
Figure 1D:
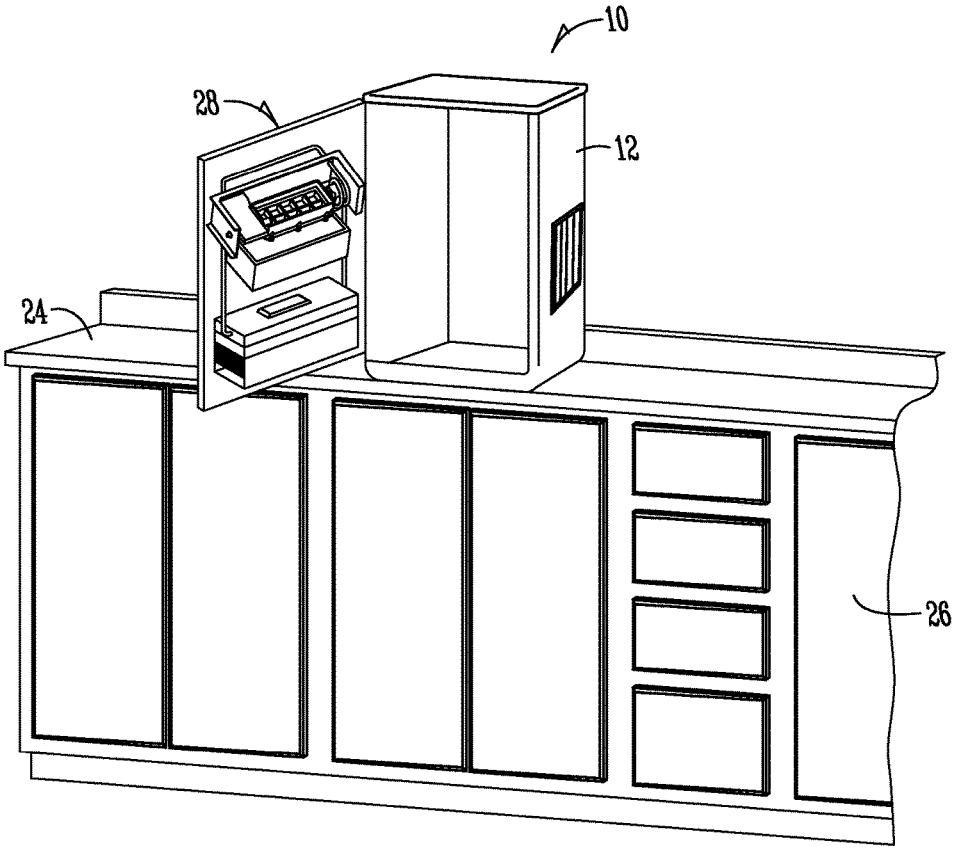
FIG. 1D is a perspective view of another refrigeration platform in accordance with an exemplary aspect of the invention.

FIGS. 1B, 1C and 1D illustrate a refrigeration platform 10 configured with one or more aspects of the invention. In FIG. 1B, a water dispenser or water cooler (i.e. refrigeration platform 10) includes a dispenser 22 for water housed in a cabinet body 12. The cabinet body 12 may also be configured with an ice maker module 28, such as one of the modules illustrated in FIGS. 4-8. Using any one of the ice maker modules 28 illustrated in the Figures, the water cooler or water dispenser may be configured to dispense ice using an ice making process assisted by a thermal electric device. Similar to the refrigerator platform, heat from off the warm side of the thermal electric device may be extracted using cool air or liquid taken from the refrigeration process used to chill the liquid being dispensed from the dispenser 22. Therefore, the same concepts described above relating to implementation into a refrigerator apply here with implementation into a water dispenser or water cooler. FIG. 1C illustrates another aspect of the invention. In FIG. 1C an ice maker module 28, such as those illustrated in FIGS. 4-8, may be configured into an under cabinet refrigeration platform 10. The under cabinet refrigeration platform 10 includes a cabinet body 12 for housing the ice maker module 28. The cabinet body 12 may be positioned underneath the counter top 24 and/or alongside a cabinet 26. The ice maker module 28 may be used to provide ice at an under cabinet location using an ice maker assisted by a thermal electric device. Ice may be delivered through a door on the cabinet directly from the ice mold or from an ice storage bin. Ice may also be retrieved from the cabinet body 12 through a door in covering relation to the icemaker, ice storage bin or cabinet body 12. Similar to the refrigerator platform 10 illustrated in FIG. 1C, a refrigerator platform 10 may be configured with one of the ice maker modules 28 shown in FIGS. 4-8. The refrigeration platform 10 may be a countertop dispenser configured for resting atop a counter 24 supported, for example, by one or more cabinets 26. The counter top refrigeration platform 10 may include a cabinet body 12 for housing the ice maker module 28. The ice maker module 28 may be configured to provide ice within the cabinet body 12 or delivered through a door using an ice maker assisted by a thermal electric device.

In still another aspect of the invention, the thermal electric device 50 may be configured with a cold side 54 and a warm side 52. An air sink 56 may be configured in thermal contact with the warm side 52 of the thermal electric device 50. Ambient air may be used to extract heat off of the air sink 56 and the warm side 52 of the thermal electric device 50. Thus, in one aspect, the thermal electric device 50 may be configured to provide cooling at the cold side 54 without bringing air to the air sink 56 from the refrigeration compartment. For example, the size and performance characteristics (e.g., operating efficiency) of the thermal electric device 50 may be selected so that the air sink 56 is capable of extracting enough heat from the warm side 52 of the thermal electric device 50 to provide a cold side 54 at the desired operating temperatures. In instances where the refrigeration platform 10 does not include refrigeration components (e.g., compressor, condenser, evaporator) the thermal electric device 50 may be configured to operate without the assistance of bringing cool air from the refrigerator compartment or freezer compartment to the air sink 56 for extracting heat from the warm side 52 of the thermal electric device 50. For example, in FIG. 1C and FIG. 1D a refrigerator platform 10 is shown. The platform may not include components for providing refrigeration (i.e. compressor, condenser, evaporator), and therefore, the thermal electric device 50 may be configured to radiate a sufficient amount of heat from the warm side 52 to provide a cold side 54 at the desired temperatures for operating an ice maker within a cabinet body 12 that does not include the aforementioned refrigeration components.

Figure 9:
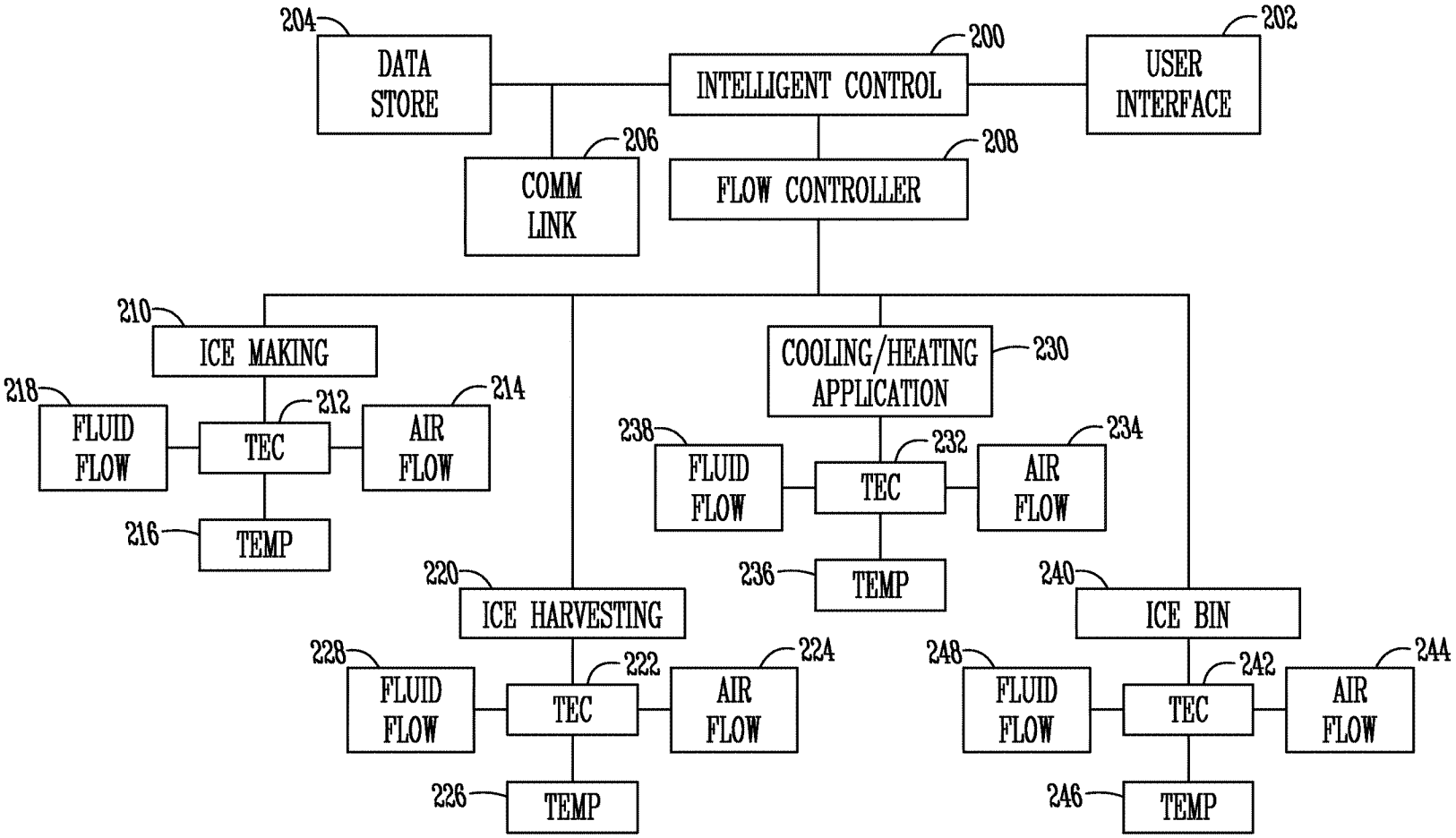
FIG. 9 is a diagram illustrating exemplary control aspects of the invention.

FIG. 9 provides a flow diagram illustrating one or more of the control processes of the present invention. To perform one or more aforementioned operations or applications, the refrigerator 10 may be configured with an intelligent control 200 such as a programmable controller. A user interface 202 in operable communication with the intelligent control 200 may be provided, such as for example, at the dispenser 22. A data store 204 for storing information associated with one or more of the processes or applications of the refrigerator may be configured in operable communication with the intelligent control 200. A communications link 206 may be provided for exchanging information between the intelligent control 200 and one or more applications or processes of the refrigerator 10. The intelligent control 200 may also be used to control one or more flow controllers 208 for directing flow of a heat carrying medium such as air or liquid to the one or more applications or processes of the refrigerator 10. For example, in an ice making application 210 the flow controller 208 and intelligent control 200 control and regulate the air flow 214 from the refrigerator compartment 14 to the thermoelectric device process 212. The thermoelectric device process 212 controls the temperature 216 of the fluid flow 218 to the ice making process 210. The rate at which the air flow 214 moves air from the refrigerator compartment 14 to the thermoelectric device process 212 for controlling the temperature 216 may be controlled using the intelligent control 200 in operable communication with one or more flow controllers 208. The rate of fluid flow 218 to the ice making process 210 may also be controlled by the intelligent control 200 operating one or more flow controllers 208. For example, the air flow process 214 may be provided by intelligent control 200 of a fan or other pump mechanism for moving air flow from the refrigerator compartment 14 to the thermoelectric device process 212. The intelligent control 200 may also be used to control the pump used to control fluid flow 218 from the thermoelectric device process 212 to the ice making process 210. The rate at which the pump and the fan operate to control air flow 214 and fluid flow 218 may be used to control the temperature 216 depending upon the rate of the ice making process 210. The intelligent control 200 may also be used to control the ice harvesting process 220. One or more flow controllers 208 under operation of the intelligent control 200 may be used to control air flow 224 to the thermoelectric device process 222 and fluid flow 228 to the ice harvesting process 220. For example, the intelligent control 200 may be used to reverse polarity of the thermoelectric device process 222 to increase the temperature 226 of the fluid flow 228 to enable the ice harvesting process 220. Intelligent control 200 may also be used to control one or more flow controllers 208 to increase the temperature 226 of the air flow 224 and communicating the air flow 224 to the ice harvesting process 220 for warming the ice mold and harvesting the ice. The temperature 226 of the fluid flow 228 and/or the air flow 224 may be controlled using the thermoelectric device process 222 for warming ice within the ice bin to provide a fresh ice product or a clear ice product depending upon an input at the user interface 202. In another aspect of the invention, the intelligent control 200 may be used to control cooling and heating applications 230, such as for example, on the refrigerator compartment door 18 of the refrigerator 10. A reservoir of water may be provided that is chilled or heated by control of the intelligent control 200. The temperature 236 of the water in the cooling or heating application 230 may be controlled by controlling the fluid flow 238 and/or air flow 234 from the thermoelectric device process 232 to the cooling or heating application 230. One or more flow controllers 208 under operable control of the intelligent control 200 may be operated to perform the cooling or heating application 230. For example, the thermoelectric device process 232 may be used to lower the temperature 236 of the fluid flow 238 to the cooling application 230. Alternatively, the temperature 236 of the fluid flow 238 may be increased using the thermoelectric device process 232 for providing heating at the heating application 230. Air flow 234 from the refrigerator compartment 14 may also be used to provide cooling or heating. The air flow 234 to the thermoelectric device process 232 may be used for the cooling application or the heating application 230. For example, the air return pathway from the thermoelectric device process 232 increases the temperature 236 at the heating application 230. Alternatively, the air flow 234 to the thermoelectric device process 232 may be used to decrease the temperature 236 at the cooling application process 230. Intelligent control 200 may also be configured to control the ice bin process 240. One or more flow controllers 208 under operable control of the intelligent control 200 may be used to control air flow 244 and/or fluid flow 248 to the ice bin process 240. The temperature 246 of the fluid flow 248 to the ice bin process 240 or the temperature of air flow 244 from the refrigerator compartment 14 to the ice bin process 240 may be controlled using one or more flow controllers 208. The thermoelectric device process 242 may be configured to provide a fluid flow 248 to the ice bin process 240 having a lower temperature 246 or a fluid flow 248 to the ice bin process 240 having a warmer temperature 246. Air flow 244 to the thermoelectric device process 242 may also be used to cool or warm the ice bin process 240. Air flow 244 from the refrigerator compartment may be used to cool the ice bin process 240 whereas air flow 244 from the thermoelectric device process 242 may be used to warm the ice bin process 240. Thus, the temperature 246 of fluid flow 248 or air flow 244 may be controlled using the intelligent control 200 in operable communication with one or more flow controllers 208 for controlling the ice bin process 240. For example, the fluid flow 248 from the thermoelectric device process 242 to the ice bin process 240 may be controlled using one or more flow controller 208 under operation of the intelligent control 200 whereby the temperature 246 of the fluid flow 248 is used in a cooling ice bin process 240 or warming ice bin process 240. Thus, one or more methods for controlling the temperature of one or more applications, such as for example, an ice making process on a refrigerator compartment door, are provided.

The foregoing description has been presented for the purposes of illustration and description. It is not intended to be an exhaustive list or limit the invention to the precise forms disclosed. It is contemplated that other alternative processes and methods obvious to those skilled in the art are considered included in the invention. The description is merely examples of embodiments. For example, the exact location of the thermoelectric device, air or fluid supply and return pathways may be varied according to type of refrigerator used and desired performances for the refrigerator. In addition, the configuration for providing heating or cooling on a refrigerator compartment door using a thermoelectric device may be varied according to the type of refrigerator and the location of the one or more pathways supporting operation of the methods of the invention. It is understood that any other modifications, substitutions, and/or additions may be made, which are within the intended spirit and scope of the invention. From the foregoing, it can be seen that the invention accomplishes at least all of the intended objectives.

What is claimed is:

1. A refrigerator comprising:

a fresh food compartment and a freezer compartment;

a door that provides access to the fresh food compartment;

an icemaker mounted remotely from the freezer compartment, the icemaker further comprising an ice mold;

a thermoelectric device comprising a warm side and a cold side disposed remotely from the ice mold;

a fluid pathway having a fluid supply line thermally connected to the cold side and the ice mold, and a fluid return line thermally connecting a fluid sink of the thermoelectric device and the ice mold; and an air pathway thermally connected to an air sink on the warm side of the thermoelectric device, the air pathway having an air supply line in fluid communication with a fan and an air return line in fluid communication with a controller.

2. The refrigerator of claim 1, wherein the air sink comprises a plurality of fins.

3. The refrigerator of claim 1, wherein the fan is disposed within the air pathway and configured to urge air from the fresh food compartment through the air pathway to the air sink.

4. The refrigerator of claim 3, further comprising a flow controller disposed downstream the air sink, and configured to direct air to any combination of the fresh food compartment, the freezer compartment, and the ice mold.

5. The refrigerator of claim 1, further comprising a pump operably coupled with the fluid pathway and configured to urge fluid through the fluid pathway.

6. The refrigerator of claim 5, further comprising an ice bucket disposed below the ice mold, wherein the fluid pathway is in thermal connection to the ice bucket.

7. The refrigerator of claim 6, wherein the fluid supply line is disposed in the direction of flow from the cold side to the ice mold, and the fluid return line is disposed in the direction of flow from the ice mold to the thermoelectric device.

8. The refrigerator of claim 7, further comprising a water dispenser disposed in the door, wherein the fluid pathway is thermally connected to the water dispenser.

9. The refrigerator of claim 8, wherein the fluid return line is thermally connected to the water dispenser for providing warm water to the water dispenser.

10. The refrigerator of claim 8, wherein the controller is located in a wall of the fresh food compartment and configured to direct fluid to any combination of the ice mold, the water dispenser, and the ice bucket, and the fan is located at the back of the refrigerator proximate a mullion wall.

11. The refrigerator of claim 10, wherein the controller is in communication with the fan and varies an air flowrate in the air pathway from the fresh food compartment to the thermoelectric device.

12. The refrigerator of claim 11, further comprising an intelligent control in operable communication with the controller and configured to control temperature.

13. The refrigerator of claim 1, wherein the icemaker is mounted on the door.

14. An ice making system in a refrigerated appliance comprising:

a refrigerated compartment;

a door that provides access to the refrigerated compartment;

an icemaker mounted in the refrigerated compartment, the icemaker further comprising an ice mold;

a thermoelectric device comprising a warm side and a cold side disposed remotely from the ice mold;

a fluid pathway thermally connected to the cold side and the ice mold and defining a fluid flow direction;

a air pathway thermally connected to the warm side; and an intelligent control in operable communication with a plurality of controllers and a plurality of fans located in the air pathway and a plurality of pumps located in the fluid pathway.

15. The ice making system of claim 14, wherein the fluid pathway further comprises a fluid supply side located in the fluid flow direction between the thermoelectric device and the ice mold, and a fluid return line, located in the fluid flow direction between the ice mold and the thermoelectric device and an air sink disposed in the air pathway and thermally connected to the warm side.

16. The fluid pathway of claim 15, further comprising a fluid supply line thermally connected to the cold side and the ice mold and a fluid return thermally connecting a fluid sink of the thermoelectric device and the ice mold.

17. The air pathway of claim 16, further comprising an air supply and an air return in fluid communication with a controller and a fan.

18. A refrigerator comprising:

a fresh food compartment and a freezer compartment;

an icemaker mounted remotely from the freezer compartment, the icemaker further comprising an ice mold;

a thermoelectric device comprising a warm side and a cold side disposed remotely from the ice mold;

a fluid pathway defining a fluid flow direction, the fluid pathway thermally coupled with the thermoelectric device and the ice mold comprising a fluid supply line located in the fluid flow direction between the thermoelectric device and the ice mold, and a fluid return line located in the fluid flow direction between the ice mold and the thermoelectric device;

an air pathway thermally connected to an air sink on the warm side of the thermoelectric device, the air pathway having an air supply line and an air return line that are in fluid communication with a controller and a fan;

an intelligent control in operable communication with a plurality of flow controllers and a plurality of fans located in the air pathway and a plurality of pumps located in the fluid pathway.

19. The refrigerator of claim 18, wherein the plurality of fans disposed within the air pathway are configured to urge air from the fresh food compartment through the air pathway to the air sink.

20. The refrigerator of claim 19, wherein the plurality of flow controllers are disposed downstream of the air sink, and configured to direct air to any combination of the fresh food compartment, the freezer compartment, and the ice mold.

* * * * *